US005394565A

United States Patent [19]

Stewart et al.

[11] Patent Number: 5,394,565

[45] Date of Patent: Mar. 7, 1995

[54] PORTABLE PLAY ENVIRONMENT

[76] Inventors: Patrick D. Stewart, Belmont; Brian D. Moose, San Francisco, both of Calif.

[21] Appl. No.: 52,512

[22] Filed: Apr. 29, 1993

[51] Int. Cl.[6] ..... A41D 11/00

[52] U.S. Cl. ..... 2/69; 2/69.5; 2/75; 2/108; 446/28; 446/26; 446/901

[58] Field of Search ..... 2/84, 69, 69.5, 75, 2/80, 94, 108, 247, 248, 249, 250, 251, 252, 105, 106, 160, 107, 112, 223, 229, 102, 113, 114, 115; 40/586, 539, 612; 446/901, 28, 26; 434/395; 11/DIG. 2

[56] References Cited

U.S. PATENT DOCUMENTS

| | | | |
|---|---|---|---|
| 1,225,863 | 5/1917 | Schaab | 2/251 |
| 2,593,218 | 4/1952 | Swain | 446/28 |
| 4,078,265 | 3/1978 | Condit | 40/586 |
| 4,218,781 | 8/1980 | Lieberman | 2/247 |
| 4,642,815 | 2/1987 | Allen . | |
| 4,710,979 | 12/1987 | Bull et al. . | |
| 4,710,981 | 12/1987 | Sanchez | 40/586 X |
| 4,723,323 | 2/1988 | Wright, Jr. . | |
| 4,860,387 | 8/1989 | Williams | 446/28 X |
| 4,898,404 | 2/1990 | Babcock . | |
| 4,975,987 | 12/1990 | Teachout | 446/28 X |
| 4,991,233 | 2/1991 | Hall | 2/115 |
| 4,999,848 | 3/1991 | Oney | 40/586 X |
| 5,031,244 | 7/1991 | Inagaki . | |
| 5,042,091 | 8/1991 | Tonkens . | |
| 5,048,123 | 9/1991 | Monson | 446/28 X |
| 5,072,456 | 12/1991 | Elin . | |
| 5,117,507 | 6/1992 | Long | 2/75 X |
| 5,121,505 | 6/1992 | Ludmer et al. . | |
| 5,210,881 | 5/1993 | Stocker, Jr. et al. | 446/28 X |

*Primary Examiner*—Jeanette E. Chapman
*Attorney, Agent, or Firm*—Douglas E. White

[57] ABSTRACT

A portable play environment functions as a coat or jacket when worn and when not worn is capable of being used as a playing surface. It may include pockets or loops which act as storage means for carrying dolls, action figures, cars or similar small toys. Raised three-dimensional play objects may be permanently incorporated into the jacket. Expandable pocket structures have a dual function. When the jacket is worn by the child, the pocket structure functions as a ordinary pocket. The pocket structure may be removed, however, when the jacket is off and is being used as a play environment. When removed, it may be expanded into the general shape of a building or other imaginary structure. Flat cloth panels have graphic indicia printed on both sides. Such indicia typically will be in the form of maps or other small-scale representations of a natural or imaginary environment. Playing fields may be formed both on the back of the jacket and on its inner lining.

5 Claims, 5 Drawing Sheets

PORTABLE PLAY ENVIRONMENT

FIELD OF THE INVENTION

This invention relates to toys and to clothing, more particularly to an item of clothing which contains both printed indicia and three dimensional features that render the item an imaginary play environment for children.

BACKGROUND OF THE INVENTION

Children are known to enjoy toys (such as dolls, action figures, miniature cars or the like) more when they are played with in the context of an imaginary play environment having a playing field (such as a scaled-down doll house, battlefield, raceway or the like) which mimics the real world within which the figure or object would be found if the toy depicting it were real. However, while children often may take their favorite dolls, toy cars, etc., with them to visit restaurants, relatives or friends, it is often not practical for them to carry the related play environment—which normally is much larger.

Prior developments in this field may be generally illustrated by reference to the following information disclosure statement:

| Pat. No. | Patentee | Issue Date |
|---|---|---|
| 5,042,091 | R. Tonkens | Aug. 27, 1991 |
| 4,710,979 | R. Bull et al. | Dec. 08, 1987 |
| 4,723,323 | J. Wright, Jr. | Feb. 09, 1988 |
| 5,121,505 | M. Ludmer et al. | Jun. 16, 1992 |
| 4,898,404 | R. Babcock | Feb. 06, 1990 |
| 5,031,244 | J. Inagaki | Jul. 16, 1991 |
| 5,072,456 | L. Elin | Dec. 17, 1991 |
| 4,642,815 | R. Allen | Feb. 17, 1987 |

U.S. Pat. No. 5,042,091 teaches a garment with a pocket-type holder for tissues, which pocket is removably attached with hook and loop fastener material, such as that sold under the trademark VELCRO.

U.S. Pat. Nos. 4,710,979 and 4,723,323 teach bibs that have activity devices on them with which to entertain children. The former patent shows removable two-dimensional toys. The latter patent shows flaps which reveal differently shaped hook and loop fastener pads, depending on the position of the flap.

U.S. Pat. No. 5,121,505 teaches a garment with map indicia printed thereon. Two-dimensional markers are attachable to the map.

U.S. Pat. No. 4,898,404 teaches a portable racecourse or roadway incorporated into a book. Turning the pages of the book reveals different types and configurations of roadways.

U.S. Pat. Nos. 5,031,244, 5,072,456 and 4,642,815 teach garments having pockets attached by hook and loop fasteners.

SUMMARY OF THE INVENTION

The present invention is a portable play environment which functions as a coat or jacket when worn and, when not worn, is capable of being used as a playing surface. It may include pockets or loops which act as storage means for carrying dolls, action figures, cars or similar small toys.

One feature of the invention is raised three-dimensional play objects permanently incorporated into the jacket, such as, by way of example, a banked raceway and raised spectator stands upon which to "race" toy cars. Other three-dimensional play objects include expandable pocket structures having a dual function. When the jacket is worn by the child, the pocket structure functions as a ordinary pocket, i.e. it may be used for the child's hands, mittens, toys or the like. The pocket structure may be removed, however, when the jacket is off and is being used as a play environment. The pocket structure is fastened to the jacket by snaps, VELCRO, or the like. When removed, it may be expanded into the general shape of a building or other imaginary structure (such as a garage, race pit area, pool cabana or the like) through the use of a folding internal support frame. In one embodiment of the invention, a pocket structure converts to a bed for a doll, complete with pillows.

Another feature of the invention is flat cloth panels or flaps which have graphic indicia printed on both sides. Such indicia typically will be in the form of maps or other small-scale representations of natural or imaginary environments. Both the outer surface, or shell, of the jacket and the inner lining thereof may be used as play environments through the emplacement of suitable indicia thereon and/or on panel flaps. When a panel is folded down so as to cover a portion of one surface of the jacket a first imaginary playing field is created by the outer indicia of the panel; say, a horse stable. When the panel is raised, visually and operatively exposing the inner indicia of the panel (and also exposing formerly hidden indicia on the jacket surface) a significantly different second playing field is created; say, a shopping mall.

If the stable/shopping mall fields (again, this conceptual theme is used by way of example only) are on the inner jacket lining surface, then the outer jacket shell surface (preferably on the back of the jacket) may have a further two more alternating playing fields; say, a frontal elevation of a playhouse with a roof when a second panel is down and a plan view of the interior of the playhouse, bordered by a swimming pool, when the second panel is raised. In other words, a total of at least four environments may be created with just two panels, one on the back of the outer shell of the jacket and one on the inner lining. More variable environments may be created with more panels. Even without such graphic panels, at least two play environments may be created, one on the outer shell and one on the inner lining.

FEATURES AND ADVANTAGES

An object of this invention is to disclose play environment apparatus for use with toys that have appearances depicting a common conceptual theme. The apparatus includes an item of clothing, typically a jacket, having a surface, typically a shell or a lining. Toy storage means are included on the clothing item, from which storage means a toy having an appearance depicting the conceptual theme may be alternately placed and removed. A first playing field is on the shell surface, the first playing field having at least one three-dimensional play object, the first playing field also depicting the conceptual theme and onto which playing field the toy will remain at rest unaided when the clothing item is in a horizontal position.

A further object is to disclose toy storage means which includes a plurality of elastic loops affixed to the clothing item, into which loops toys may be removably inserted and grasped thereby.

Another feature is a second playing field on the lining surface, the second playing field having graphic indicia formed thereon, which lining indicia forms an image that depicts the conceptual theme.

As yet another feature the toy storage means may include at least one pocket structure affixed to the clothing item which may be removed from the clothing item and placed on or in close proximity to either playing field and which pocket structure is structurally configurable to depict in external appearance the conceptual theme.

Further play environment apparatus is disclosed which includes an item of clothing and a panel hingedly attached thereto (typically at the back of the shell), the panel having a first (outer panel) surface and a second (inner panel) surface. A first playing field is printed or stitched on the first surface, the first playing field having a first set of graphic indicia formed thereon, which first indicia form a first image that depicts a conceptual play theme. A toy will remain at rest unaided on the first playing field when the panel is rotated about its hinge to a first horizontal position in which the first surface is upwardly exposed. A second playing field is found on the second surface, the second playing field having a second set of graphic indicia formed thereon, which second indicia form a second image that depicts the conceptual play theme. A toy will remain at rest unaided on the second playing field when the panel is rotated about its hinge to a second horizontal position in which the second surface is upwardly exposed.

A further feature of the second play apparatus embodiment is a third set of graphic indicia formed on a third surface (typically at the back of the shell, under the panel), which third indicia form a third image that depicts the conceptual play theme and expands the second playing field in area. The second and third indicia are visually and operatively exposed when the panel is in the second position and the second and third indicia are overlayed against each other and unexposed when the panel is in the first position.

Yet another feature is fastening means, such as hook and loop fastener or snaps, for temporarily holding the panel in the first position.

Another feature is an apparatus which is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, such words as "upwardly," "downwardly," "leftwardly," and "rightwardly" will refer to directions in the drawings to which reference is made unless otherwise stated. Similarly, such words as "inwardly" and "outwardly" will refer to directions toward and away from, respectively, the geometric center of a device or area and designated parts thereof.

DRAWING REFERENCE NUMERALS

Figure 1:
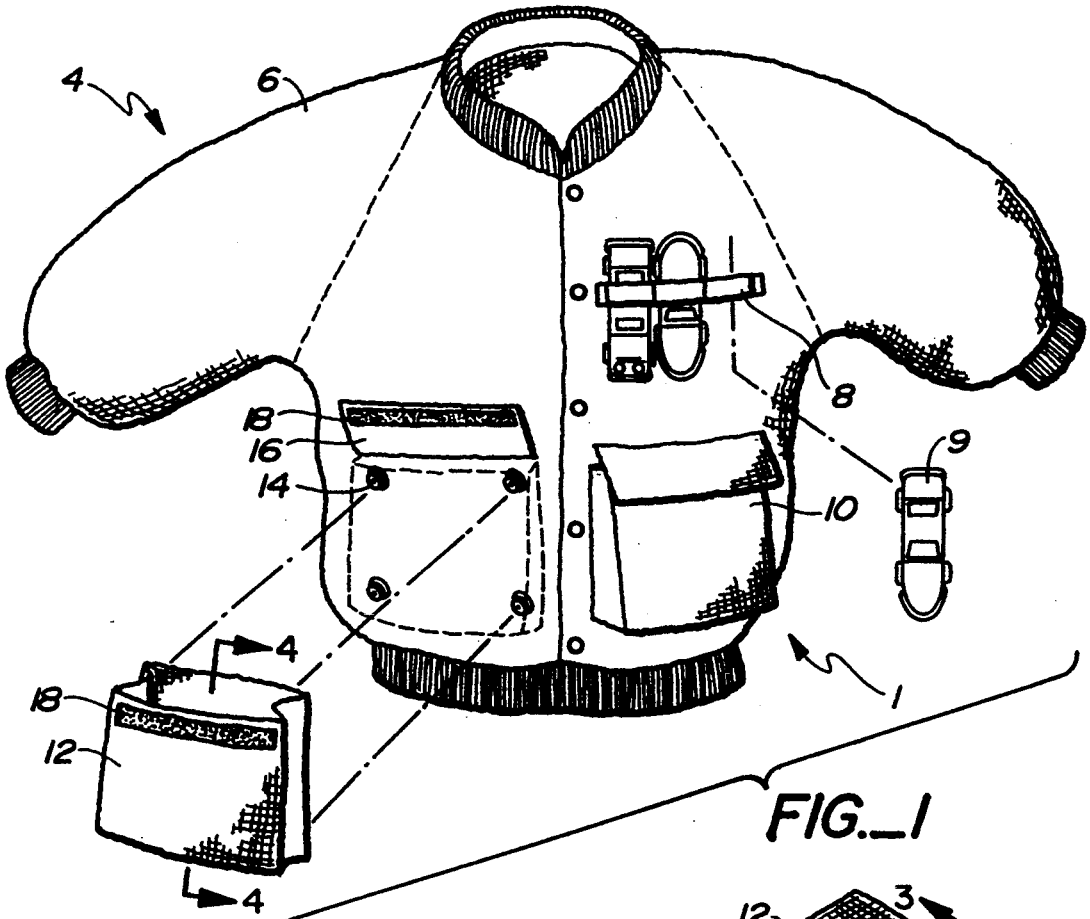
FIG. 1 is a partially-exploded frontal perspective view of a play environment apparatus of this invention.

1 play environment apparatus
4 jacket
5 lining of 4
6 shell of 4
8 loop
9 toy car
10 pocket structure
12 pocket structure
13 fabric of 12
14 snap of 12
16 flap of 12
18 hook and loop fastener material
19 frame of 12
20 member of 19
21 member of 19
22 hinge of 20
23 hinge of 21
32 playing field of 6
34 stand of 32
36 track of 32
42 playing field of 5
44 graphic indicia of 42
46 off road track of 44
48 lake of 44
101 play environment apparatus
104 jacket
106 shell of 104
109 toy doll
110 pocket structure
112 pocket structure
114 hook and loop fastener
116 flap of 112
124 pocket structure
125 pocket structure
126 band of 124
128 flap of 124
129 pillow of 128
130 panel on 106
131 outer surface of 130
132 playing field of 104, first
133 upper edge of 130
134 outer panel indicia
135 inner panel indicia
136 playhouse of 132

137 inner surface of 130
138 hook and loop fastener
139 hook and loop fastener
142 playing field of 104, second
144 graphic indicia of 142
146 floor plan of 136
148 pool

DESCRIPTION OF A PREFERRED EMBODIMENT

Referring to FIG. 1, there is illustrated therein a play environment apparatus 1 of this invention. Apparatus 1 comprises an item of clothing, namely a coat or jacket 4, into which has been incorporated various two-dimensional and three-dimensional devices for aiding the imagination of a child at play.

On the front of the outer surface, or shell 6, of the jacket 4 is incorporated two types of toy storage means, namely elastic loops 8 and pocket structures 10, 12. Loose toys having structural and/or graphical appearances sharing a conceptual theme, such as toy cars 9, may be held within such storage means when a child is using the jacket 4 as an article of clothing, as opposed to a play environment.

Some or all pocket structures, e.g. pocket structure 12, may be held temporarily in place on the shell 6 by suitable attachment means, such as hook and loop fastener material, or by snaps 14. When affixed to the shell, the top opening of the pocket structure 12 may be releasably sealed with a pocket flap 16 of conventional construction. The flap is sewn or otherwise permanently attached to the shell 6 and may bear hook and loop fastener material 18, snaps (not illustrated), or the like for mating with similar fastening means near the top of the pocket structure 12 in order to prevent toys stored therein from falling out while the jacket 4 is being worn.

Figure 2:
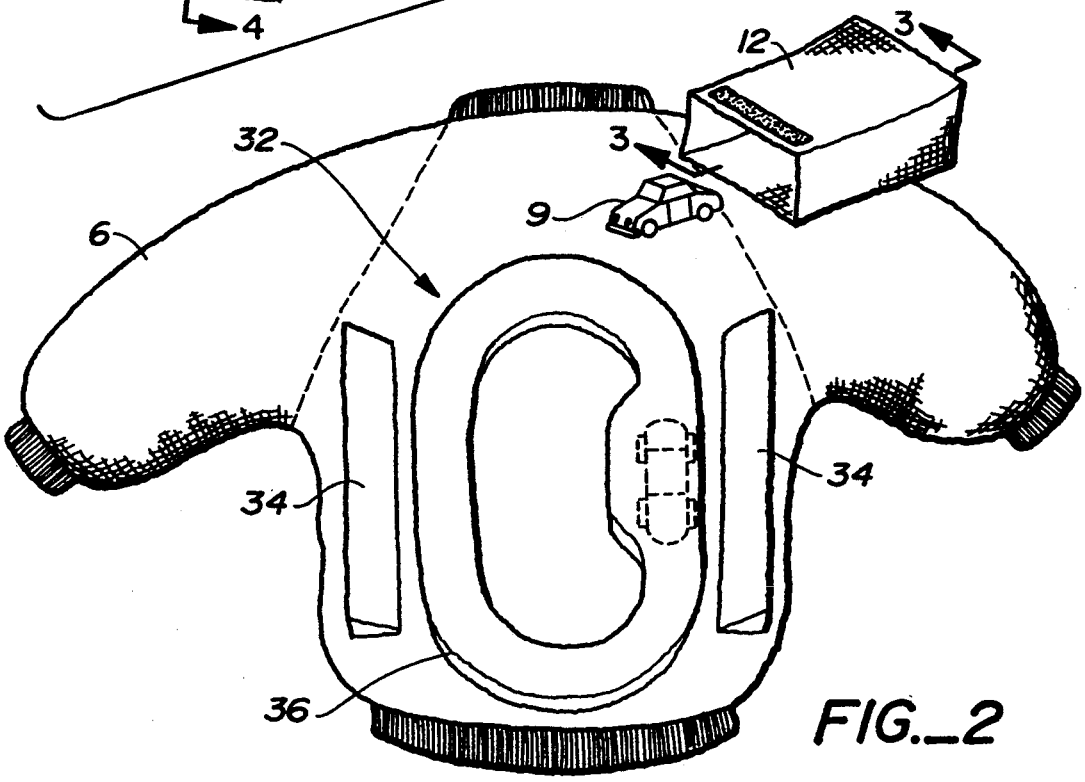
FIG. 2 is a rear perspective view of the apparatus of FIG. 1.
Figure 3:
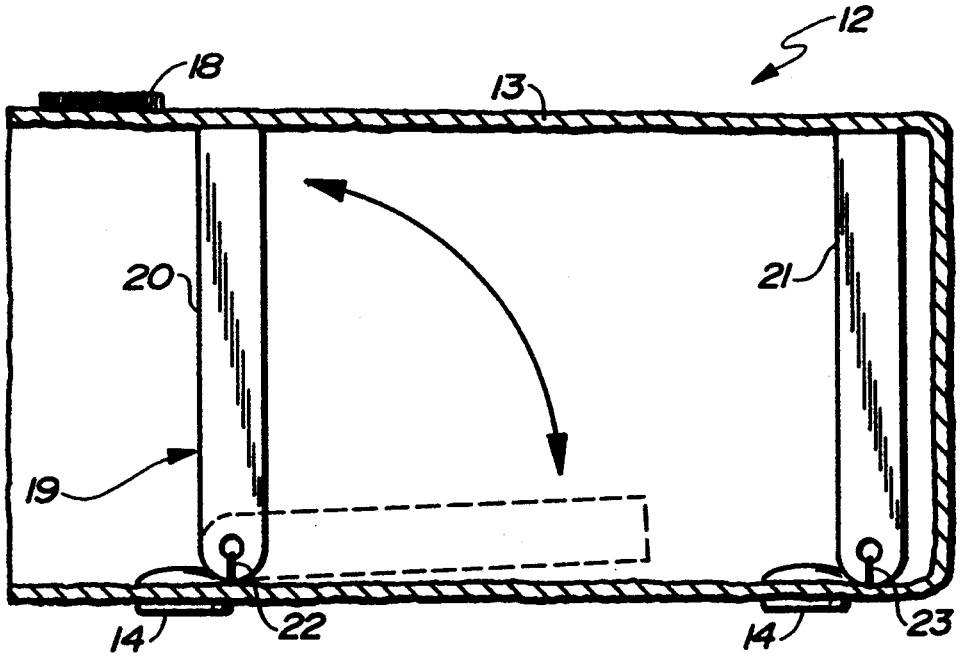
FIG. 3 is an enlarged sectional elevation of an expanded pocket structure of the apparatus, taken along line 3—3 of FIG. 2.
Figure 4:
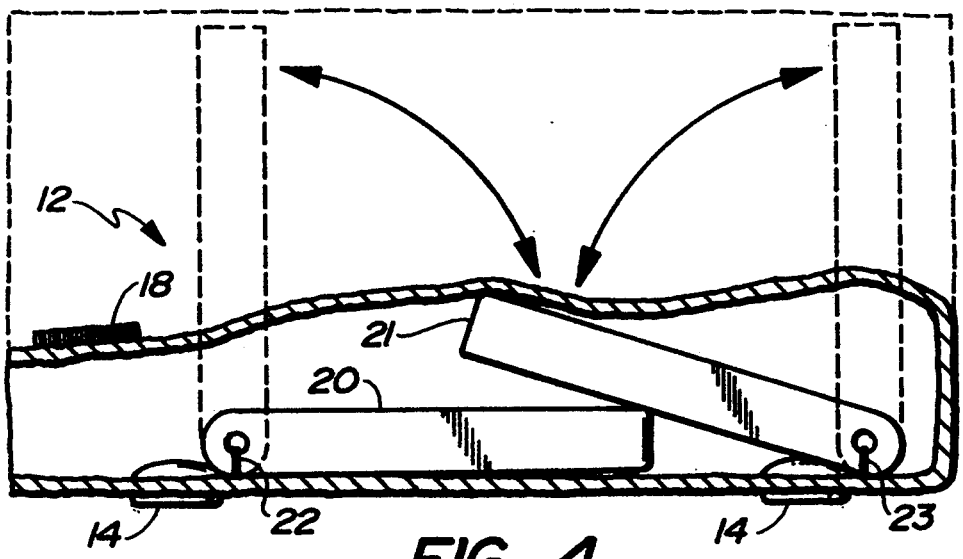
FIG. 4 is an enlarged sectional elevation of the pocket structure of FIG. 3 in a collapsed position, taken along line 4—4 of FIG. 1.

Conversion of the pocket structure 12 from storage means for a toy (or for the user's hand) to a play object which itself depicts the common conceptual theme of the toy is illustrated in FIGS. 3 and 4. FIG. 3 shows the pocket structure 12 in an expanded position, such as it typically assumes when being used as a garage (FIG. 2) or other miniature version of a real world or imaginary structure. FIG. 4 shows the pocket structure in a collapsed position, such as it typically would assume when attached to the jacket 4 for use as a conventional pocket.

A rigid internal frame assembly 19 is be comprised of two U-shaped members 20, 21, which pivot about sewn-in hinges 22, 23. Rotating the frame members about their hinges stretches or unfolds the fabric 13 of the pocket structure 12 so as to convert the structure from the collapsed "pocket" or storage mode shown in FIG. 4 to the expanded "structure" or play mode shown in FIG. 3.

In substitution for the frame 19 illustrated in the drawing, any suitable alternative collapsible frame may be used to collapse and expand the pocket structures of this invention. For example, the frame assembly 19 could be configured to form a peaked "roof" on the pocket structure 12. The pocket structure could be decorated with indicia or three-dimensional objects, i.e. windows, shingles or the like, tending to establish the garage image within the automotive conceptual play theme.

FIG. 2 illustrates the rear of the shell 6 of the jacket 4, where a first, or shell, playing field 32 may be found. Shell playing field 32 is principally comprised of a group of three-dimensional play objects which, taken together, depict the conceptual theme of the stored toy cars 9, namely a pair of spectator stands 34 and a raised bank oval racing track 36, all of which are permanently mounted to the shell 6 by thread, glue or similar means. These three-dimensional play objects may be made of molded plastic or they may be fabric filled with foam or the like. The 3-D play objects of the playing field 32 may be augmented with printed graphic two-dimensional indicia (not illustrated), to further enhance the child's play experience.

To play with the shell playing field 32, the child removes the jacket 4 and spreads it out horizontally on a level surface, such as a floor or table, with the back of the shell 6 upward. A pocket structure 12 may be removed and expanded to form an imaginary garage or pit area when placed on or in close proximity to the field 32. One or more toy cars can be removed from the toy storage means 8, 10, 12 and run around the track 36 and in and out of the structure 12. Action figures could be seated on the stands 34 and otherwise manipulated in play. The toys may be moved about, but, due to gravity, will rest in place unaided when released by the child. In this manner, a single child may play on the field 32 with a large plurality of toys.

Figure 5:
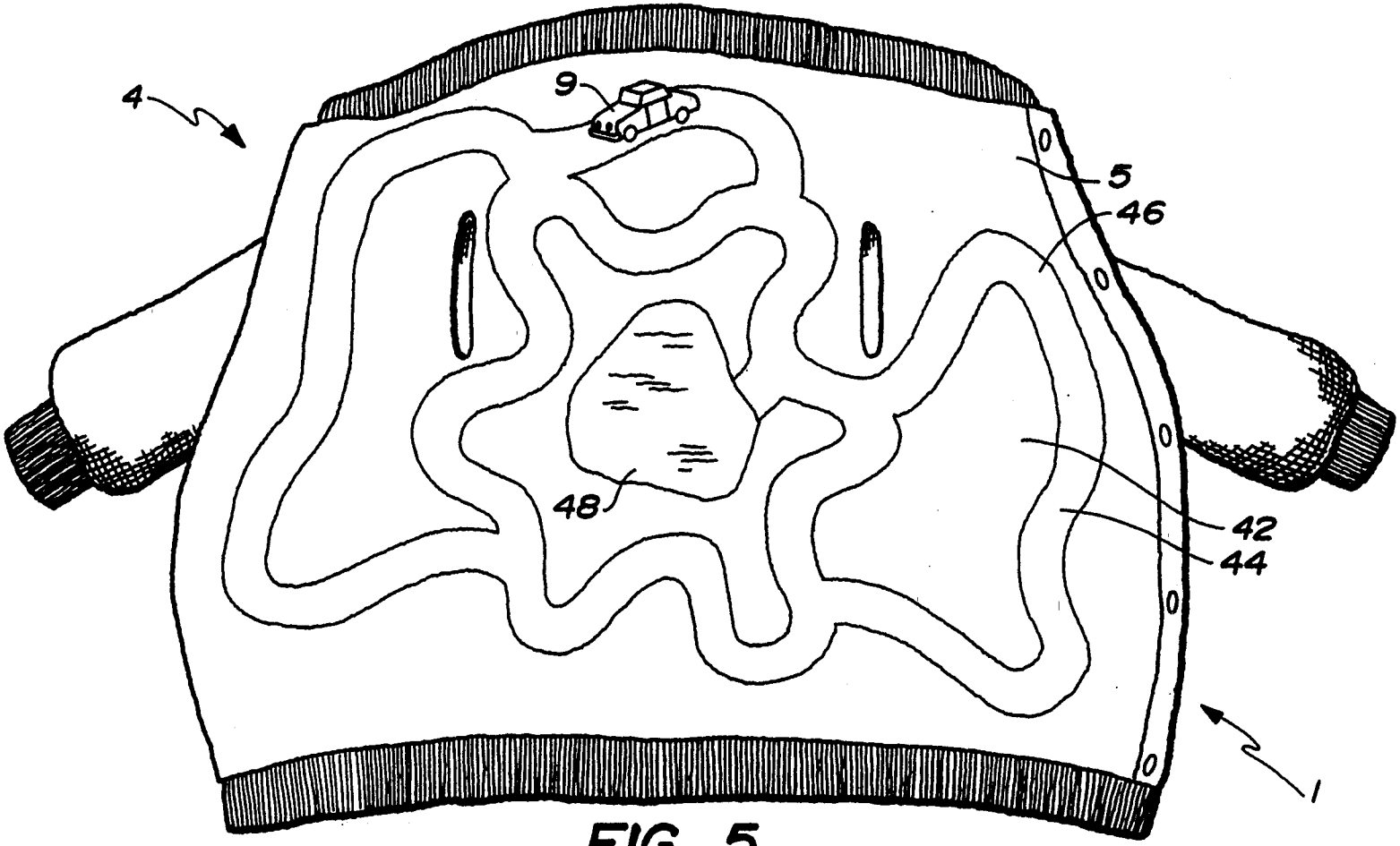
FIG. 5 is a perspective view of the apparatus of FIG. 1, unfolded so as to reveal the lining thereof.

FIG. 5 illustrates a second, or lining, playing field 42. Preferably, the lining playing field will be comprised of 2-D graphic indicia 44 which are printed, stitched or otherwise formed on the lining 5 of the jacket 4. While the borders of the lining field are generally defined by the indicia 44, portions of the field may be blank. The indicia 44 form an image which graphically depicts the shared conceptual theme. Raised padded areas might be used to give a slight three-dimensionality to the lining playing field 42, but, obviously, the child's comfort while wearing the jacket must be taken into account.

The lining playing field 42 illustrated depicts in a bird's eye view or "map" an imaginary off-road race track 46, complete with lake 48, which complements the paved formula race track 36 of the shell playing field 32. Again, suitable toy cars and/or action figures (sharing the common automotive conceptual theme of the playing fields 32, 42) may be brought along with the jacket within the storage means to be used in association with the lining playing field 42. Such toys may be sold with the jacket or may be selected by the child from his or her own existing collection. The convertible pocket structures may be used with either playing field 32, 42.

Figure 6:
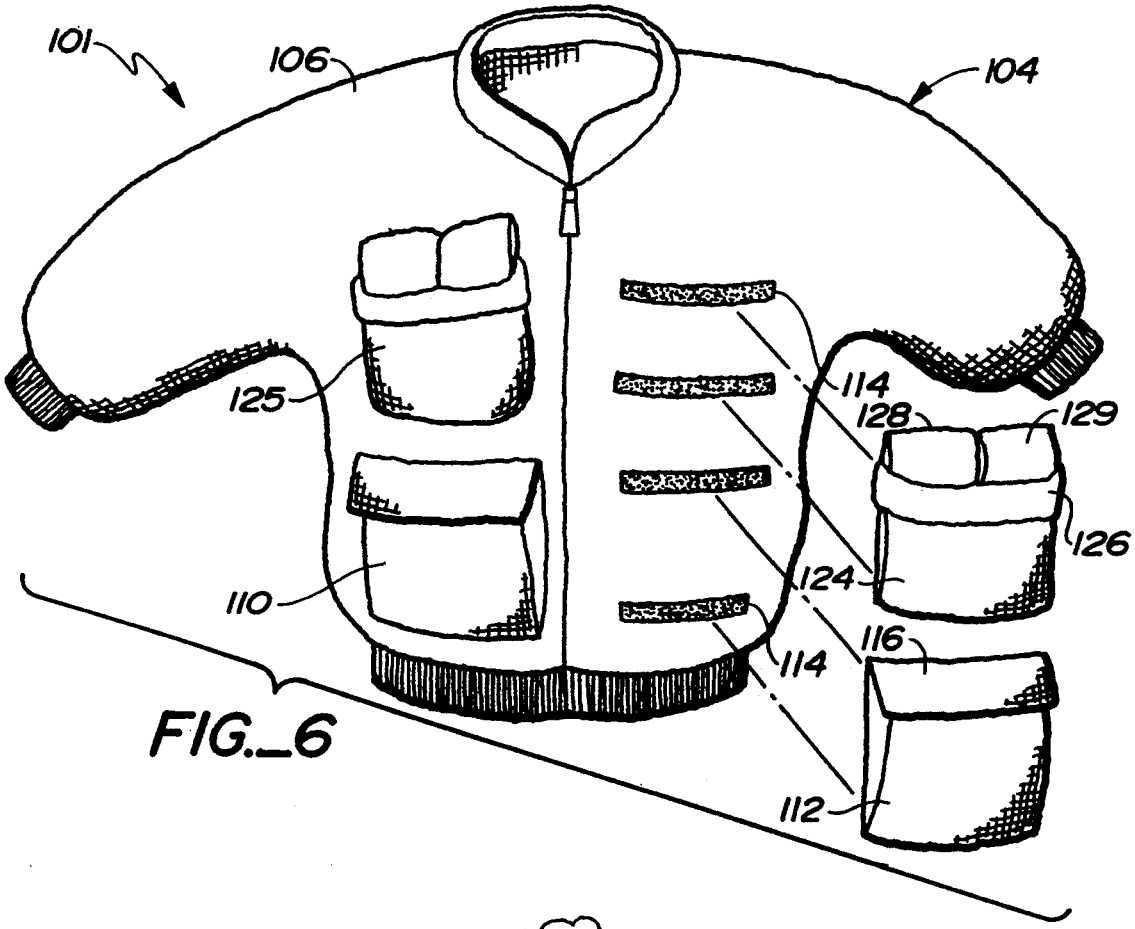
FIG. 6 is a partially-exploded frontal perspective view of a second play environment apparatus of this invention.
Figure 7:
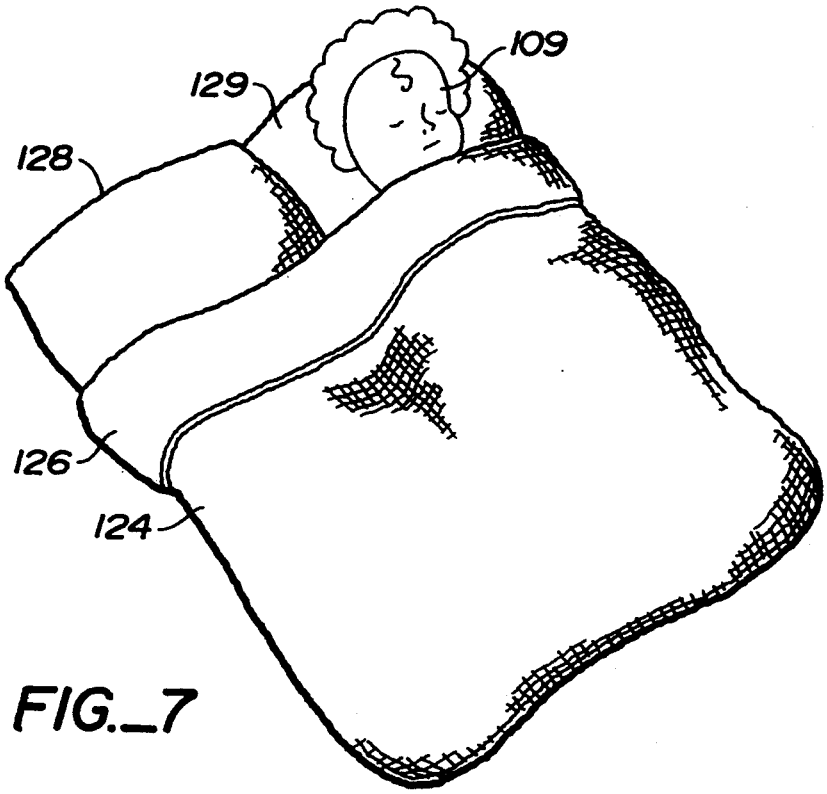
FIG. 7 is an enlarged perspective view of a pocket structure of the apparatus of FIG. 6.

FIGS. 6–8 illustrate a second embodiment of the invention. Referring to FIG. 6, there is illustrated therein a play environment apparatus 101 which comprises a jacket 104. Into the jacket has been incorporated various 2-D and 3-D devices for aiding the imagination of a child at play.

On the front of the shell 106 of the jacket 104 is incorporated toy storage means such as pocket structures 110, 112, 124, 125. Additionally, or alternatively, elastic loops (not illustrated) could be employed as toy storage means. Loose toys configured to have structural and/or graphical appearances depicting a shared or common conceptual theme, such as a toy doll 109 (FIG. 7), may be held within such storage means when a child is using the jacket 104 as an article of clothing.

Some or all pocket structures, e.g. pocket structures 112, 124, may be held temporarily in place on the shell 106 by suitable attachment means, such as hook and loop fastener material 114, or by snaps. When affixed to the shell, the top opening of the pocket structure 112 may be releasably sealed with a pocket flap 116 of conventional construction. The flap may be sewn or otherwise permanently attached to the shell, as in the previous embodiment, or it may be permanently attached to the pocket structure and travel with the latter, as shown in FIG. 6. The pocket flap 116 may bear hook and loop fastener material, snaps, or the like for mating with similar fastening means near the top of the pocket structure 112 (not illustrated).

Conversion of the pocket structure 112 from storage means for a toy (or for the user's hand) to a play object which itself depicts the conceptual theme of the toy proceeds as illustrated in FIGS. 3 and 4 for the structure 12 of the previous embodiment. In this case, the structure 112 might be configured so as to be able to be imagined to be, for example, a pool cabana for use in connection with a playhouse playing field formed on the back of the jacket, as discussed below.

FIG. 7 is a detail view of another removable pocket structure, namely pocket structure 124. The flap 128 of this pocket structure has miniature pillows 129 sewn onto its outer surface. During wear, the flap and pillows overlap the top of the pocket structure 124 (note the appearance of the similar pocket structure 125 in FIG. 6). During play, the flap 128 and pillows 129 can be tucked into the top opening of the pocket structure 124 so as to simulate the look of a bed. Thereby, through use of imagination, a "child" (doll 109) may be tucked into bed. A band 126 imitates the look of pulled-down bed covers.

Figure 8A:
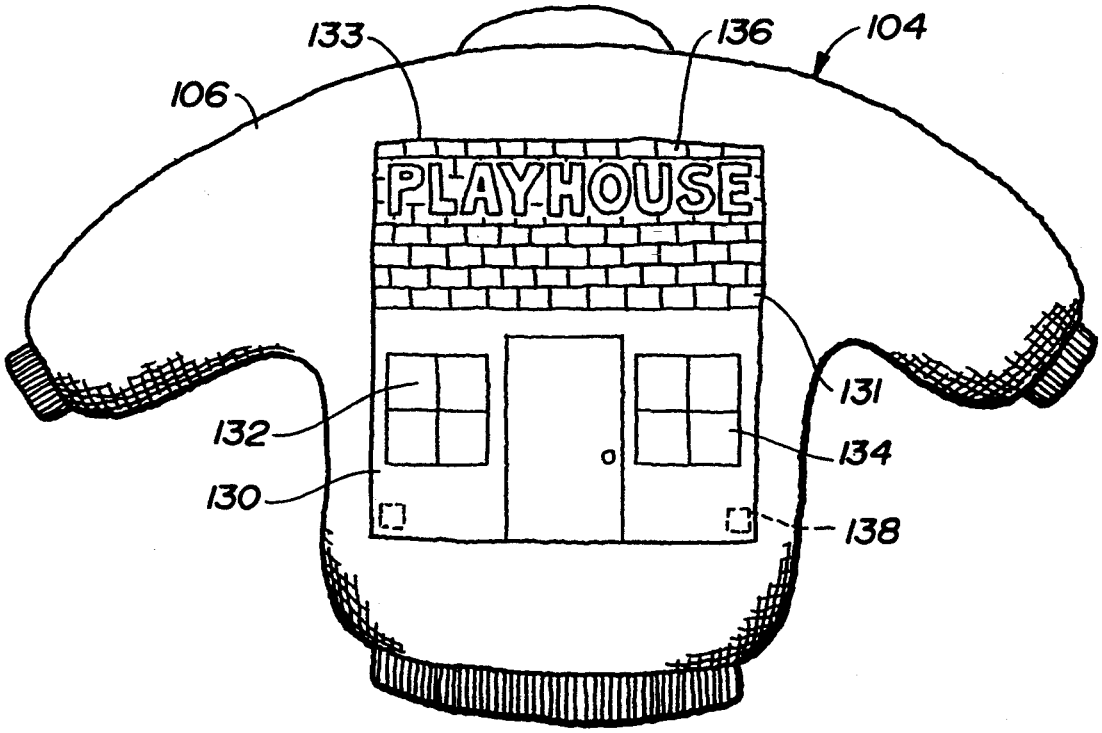
FIG. 8A is a rear perspective view of the apparatus of FIG. 6, FIG. 8B showing the graphic panel thereof in a second position.

FIG. 8A illustrates the rear or back of the shell 106 of the jacket 104. A flexible fabric panel 130 is sewn to the shell along a top edge 133 of the outer periphery of the panel. The line of stitches forms a hinge about which the panel may be rotated with respect to the shell. On the outer surface 131 of the panel, a first playing field 132 may be found. The first playing field 132 is comprised of two-dimensional graphic indicia (the outer panel indicia 134), which indicia depict the exterior of a playhouse 136. Three-dimensional objects might also be added to the back of the shell, such as trees or the like. The bottom edge of the panel 130 is removably attached to the shell 106 by fastening means, preferably hook and loop fastener material 138, 139 (also see FIG. 8B). The fastening means serves to temporarily hold the panel in the first position so that it will not flap around loosely when the jacket is worn.

The first playing field 132 and its outer panel indicia 134 are exposed to view and play when the panel 130 is in a first unfolded horizontal position, as shown in FIG. 8A.

To play with the first playing field 132, the child removes the jacket 104 and spreads it out on a level surface with the back of the shell 106 upward. A doll may be laid upon the playhouse 136, creating the impression of a person approaching or leaving a house. A toy car could be "parked" outside the house.

Figure 8B:
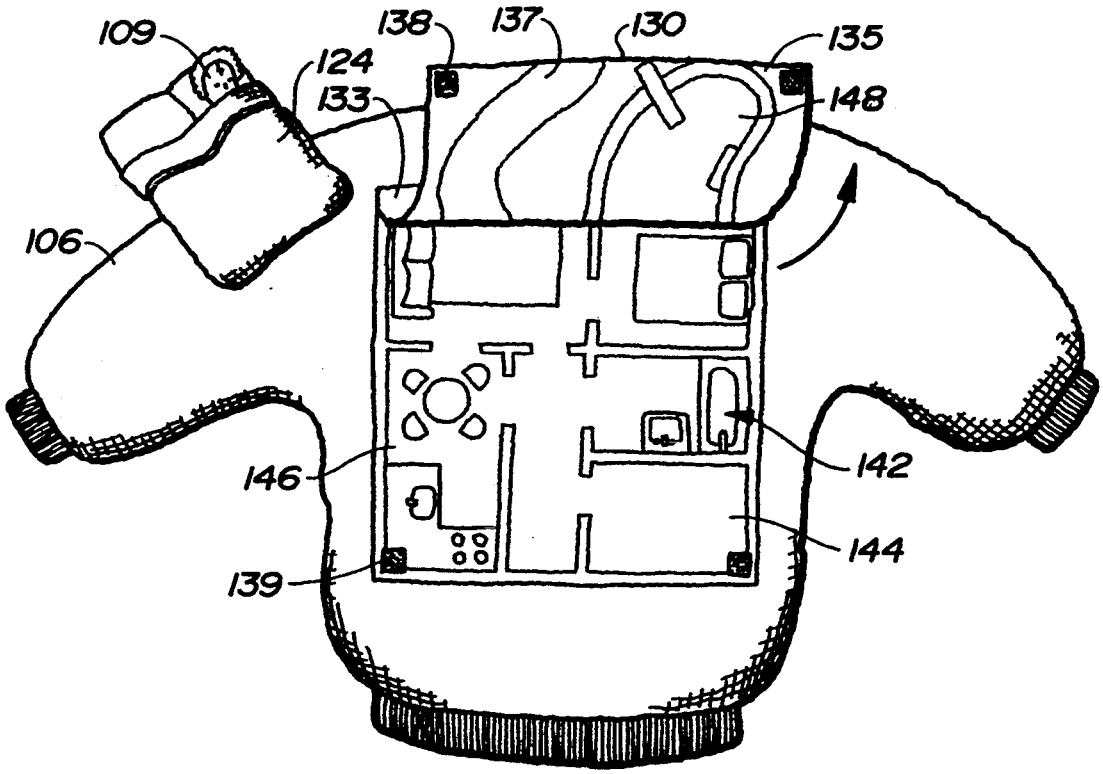

FIG. 8B illustrates a second playing field 142. Again, the second playing field preferably will be comprised, at least partially, of 2-D graphic indicia 144 which are printed, stitched or otherwise formed on the outwardly facing surface of the back of the shell 106. Additionally, however, a second set of panel indicia, namely inner panel indicia 135, are formed on the inner surface 137 of the panel 130. When the panel 130 is raised and folded back over upon itself along its "hinged" upper edge 133 into a second horizontal position, the previously covered shell indicia 144 and inner panel indicia 135 are exposed to view and play, and, in turn, the outer panel indicia 134 become covered. The indicia 135, 144 combine to form a second playing field 142 which is up to twice as large as the first playing field 132.

The second playing field 142 illustrated creates a floor plan 146 of the playhouse 136 and a back yard associated therewith, complete with pool 148, to complement the external playhouse depicted (in a domestic conceptual theme) on the first playing field 132. Again, suitable toys may be brought along with the jacket to be used in association with the playing fields 132, 142 and held in the toy storage means. Such toys may be sold with the jacket or may be selected by the child from his or her own existing collection. In this case, all toys, fields and pocket structures share a common domestic play theme.

To play with the second playing field 142, a pocket structure 124 may be removed to form an imaginary bed for a doll 109. Dolls or other action figures could be seated in the various "rooms" of the "house" and otherwise manipulated in play. Miniature dollhouse furniture and furnishings could be brought along and arranged on the playing field 142.

Thus, the panel 130 of this invention not only allows two playing fields to occupy the same area of the jacket, but the total available playing area may be up to three times the occupied jacket area.

Furthermore, multiple panels may be sewn onto the same space. If they all are sewn along their common top edges, then turning them (like the pages of a book) will create multiple alternating inner playing fields, representing, say, the multiple floors of a house. If multiple panels are sewn along different edges—one or more on the top, one or more on the right side, one or more on the left side, and so on—then unfolding them will create a a rich variety of alternately selectable inner fields, up to five times as large in size as the space occupied on the shell when folded together.

As in the previous embodiment, the lining of the jacket 104 (not illustrated) may be utilized for a third playing field and, with an inner panel or panels, more.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, sizes, operational features or the like. Therefore, the above description and illustrations should not be construed as limiting the scope of the invention which is defined by the appended claims.

What is claimed is:

1. Play environment apparatus for use with toys that have appearances depicting a common conceptual theme including:

an item of clothing having a surface;

toy storage means on the clothing item, from which storage means a toy having an appearance depicting the conceptual theme may be alternately placed and removed;

a first playing field on the surface, the first playing field having at least one three-dimensional play object, the first playing field also depicting the conceptual theme and onto which playing field the toy will remain at rest unaided when the clothing item is in a horizontal position;

a lining inside the clothing item; and a second playing field on the lining, the second playing field having graphic indicia formed thereon, which lining indicia forms an image that depicts the conceptual theme.

2. The apparatus of claim 1 wherein:

the toy storage means includes a plurality of elastic loops affixed to the clothing item, into which loops toys may be removably inserted and grasped thereby.

3. The apparatus of claim 1 wherein:

the toy storage means includes at least one pocket structure affixed to the clothing item which pocket structure may be removed from the clothing item and placed on or in close proximity to either playing field and which pocket structure is variably structurally configurable to depict in external appearance the conceptual theme.

4. The apparatus of claim 3 further including:

a collapsible frame inside the pocket structure, which frame may be moved from a first position wherein the pocket structure depicts in external appearance a pocket to a second position wherein the pocket structure depicts in external appearance the conceptual theme.

5. The apparatus of claim 4 wherein:

the item of clothing is a jacket.

* * * * *